US006243682B1

(12) United States Patent
Eghtesadi et al.

(10) Patent No.: US 6,243,682 B1
(45) Date of Patent: Jun. 5, 2001

(54) UNIVERSAL ACCESS PHOTOCOPIER

(75) Inventors: Khosrow Eghtesadi, Brookfield; Nathaniel M. Gifford, Trumbull; John F. Braun, Weston; Jeffrey D. Pierce, Norwalk; Michael M. Kaye, Weston; Michael O'Hare, Fairfield, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/188,273

(22) Filed: Nov. 9, 1998

(51) Int. Cl.[7] ..... G10L 21/06
(52) U.S. Cl. ..... 704/270; 704/271; 704/275
(58) Field of Search ..... 704/270–275

(56) References Cited

U.S. PATENT DOCUMENTS

| | | | | |
|---|---|---|---|---|
| 4,459,673 | | 7/1984 | Shibazaki et al. | 364/513.5 |
| 4,500,971 | | 2/1985 | Futaki et al. | 364/513.5 |
| 4,766,529 | | 8/1988 | Nakano et al. | 364/513.5 |
| 5,790,279 | * | 8/1998 | Sakellaropoulos | 358/498 |
| 5,802,220 | * | 9/1998 | Black et al. | 382/276 |
| 6,041,200 | * | 3/2000 | Glass et al. | 399/82 |

* cited by examiner

*Primary Examiner*—Tālivaldis I. Šmits
*Assistant Examiner*—Susan Wieland
(74) *Attorney, Agent, or Firm*—Ronald Reichman; Michael E. Melton

(57) ABSTRACT

This invention is a system that enables handicapped and disabled individuals to control and use office photocopiers. The foregoing is accomplished by coupling a interface to a diagnostic communication port on the photocopier. The diagnostic port may be used to simulate the pressing of keys on the photocopier control panel. A software program running on a personal computer is coupled to the interface so that the interface may duplicate the actions of the photocopier control panel. A voice, keyboard and touch screen interface is added to the software program to permit several keys to be issued with a single phrase or touch. The user may use voice or the keyboard or the touch screen or any combination of the above to operate the photocopier. The addition of wireless audio may also be utilized to allow hands-free operation of the photocopier. An audio voice feedback provides information about what command was exactly executed. The system audibly reports the status of the photocopier.

7 Claims, 11 Drawing Sheets

FIG. 9A

200

201

| VOICE COMMAND | KEYBOARD ENTRY |
|---|---|
| RESET | R |
| RESET COPIER | OR |
| STOP | C |
| PRINT NOW | P |
| COPIES | O |
| ZOOM | Z |
| PAPER-SELECT | S |
| FINISHING | F |
| DUPLEX | D |
| EXPOSURE | E |
| CLEAR | OL |
| SORTING OFF | FG |
| SORTING ON | FN |
| SORT AND STAPLE | FT |
| BATCH | FB |
| BYPASS | SM |
| LETTER | SL |
| LEDGER | ST |
| LEGAL | SG |
| AUTOMATIC | A |
| DARKER | EK |
| LIGHTER | EL |
| ZOOM FIFTY PERCENT | Z50 |
| ZOOM HUNDRED PERCENT | Z100 |
| ZOOM HUNDRED FIFTY PERCENT | S150 |
| ZOOM 2 HUNDRED PERCENT | Z200 |
| 1 SIDED TO 1 SIDED | DNI |
| I SIDED TO 2 SIDED | DNW |
| 2 SIDED TO 2 SIDED | DTW |
| 2 SIDED TO 1 SIDED | DTI |
| 2 SIDED TO 2 IN 1 | DTG |
| 1 SIDED TO 2 IN 1 | DNG |
| BOOK TO 1 SIDED | DVI |
| BOOK TO 2 SIDED | DVW |
| BOOK TO 2 IN 1 | DVG |

200

210

| | |
|---|---|
| LEDGER TO LEDGER | ZLB |
| LEGAL TO LEGAL | ZGA |
| LETTER TO LETTER | ZTH |
| INVOICE TO INVOICE | ZIV |
| LEDGER TO INVOICE | ZLV |
| LEDGER TO LETTER | ZLH |
| LEDGER TO LEGAL | ZLA |
| LEGAL TO LETTER | ZGH |
| LEGAL TO INVOICE | ZGV |
| LETTER TO LEDGER | ZTB |
| LETTER TO INVOICE | ZTV |
| LEGAL TO LEDGER | ZGB |
| LETTER TO LEGAL | ZTA |
| INVOICE TO LEDGER | ZIB |
| INVOICE TO LEGAL | ZIA |
| INVOICE TO LETTER | ZIH |
| OK | < ENTER > |
| STOP LISTENING | $H$ |
| ( 1 TO 99 ) COPIES | 0B ( 1 TO 99 ) |
| ZOOM ( 50 TO 200 ) | Z ( 50 TO 200 ) |

TABLE II. VOICE COMMANDS AND ASSOCIATED KEYBOARD ENTRY

FIG. 9B 205 206 207

| VOICE COMMAND | KEYBOARD ENTRY | VOICE RESPONCE |
|---|---|---|
| LIST OPTIONS | OL ] | COPIES FINISHING DUPLEX PAPER-SELECT ZOOM EXPOSURE |
| COPIES OPTIONS | O ] | 1 TO 99 COPIES PRINT STOP |
| FINISHING OPTIONS | F ] | SORTING OFF SORTING ON SORT AND STAPLE BATCH |
| DUPLEX OPTIONS | D ] | ORIGINAL TO COPY OPTIONS 1 SIDED 2 SIDED BOOK 2 IN 1 EXAMPLE 1 SIDED TO 2 SIDED |
| PAPER SELECT OPTIONS | S ] | BYPASS LETTER LEDGER LEGAL |
| ZOOM OPTIONS | Z ] | ZOOM FIFTY TO 2 HUNDRED PERCENT EXAMPLE ZOOM 8 7 OR ORIGINAL TO COPY OPTIONS LEDGER LEGAL LETTER INVOICE EXAMPLE LETTER TO LEDGER |
| EXPOSURE OPTIONS | E ] | LIGHTER DARKER |

TABLE III. VOICE COMMANDS FOR HELP

FIG. 10

UNIVERSAL ACCESS PHOTOCOPIER

FIELD OF THE INVENTION

This invention relates generally to the field of photocopiers and more particularly to the field of controlling photocopiers.

BACKGROUND OF THE INVENTION

Persons with any of a variety of physical problems may be classified as handicapped or disabled individuals. The social importance of restoring handicapped or disabled persons to usefulness is, of course, widely accepted and the economic value which this represents has come to be recognized as having great significance for society. It has been estimated that a disabled person who has been provided with vocational rehabilitation services and has been placed in employment will, in the course of his/her working life, pay back in taxes ten times the amount of money spent for his/her rehabilitation.

Many handicapped and disabled individuals are unable to obtain employment because they cannot use the machines and equipment normally found in an office or factory. For instance, typical office photocopiers present usability problems to wheel chair users, vision impaired users and blind users. The foregoing classes of people find it difficult to control and use office photocopiers. Thus, often times they are denied gainful employment.

SUMMARY OF THE INVENTION

This invention overcomes the disadvantages of the prior art by providing a system that enables handicapped and disabled individuals to control and use office photocopiers. The foregoing is accomplished by coupling an interface to a diagnostic communication port on the photocopier. The diagnostic port may be used to simulate the pressing of keys on the photocopier control panel. A software program running on a personal computer is coupled to the interface so that the interface may duplicate the actions of the photocopier control panel. A voice, keyboard and touch screen interface is added to the software program to permit several keys to be used with a single phrase or touch. The user may use voice, the keyboard or the touch screen, or any combination of the above, to operate the photocopier. The addition of wireless audio may also be utilized to allow hands-free operation of the photocopier. An audio voice feedback provides information about exactly what command was executed.

The apparatus of this invention utilizes a speaker-dependent speech recognition engine. Thus, the photocopier may be operated by the speakers of many different languages. The reason for this is that the user of the photocopier trains the speech recognition engine of the photocopier to recognize commands in the user's language.

Furthermore, information regarding photocopier malfunctions or problems may be indicated by a photocopier voice output, i.e., location of paper jams, lack of toner, etc. The above information may also be displayed on a user interface.

The apparatus of this invention may also execute a plurality of commands by the user, enunciated by a single phrase, i.e., "one sided to two sided". The foregoing means that the photocopier will take the one sided paper being input or copied and have the photocopier copy the information on both sides of the paper being output. The user may also access by voice command any function from any screen.

The photocopier also has a help menu which uses the photocopier voice output to inform the user of specific information about different photocopier functions. For example, the user says "finishing options" and the photocopier says "sorting off, sorting on, sort and staple, batch, etc." The photocopier simultaneously displays the above finishing screen options on the touch screen. Then the user selects the option he/she desires.

BRIEF DESCRIPTION OF THE DRAWING

FIGS. 9A and 9B are a table of voice commands and corresponding keyboard entries; and FIG. 10 is a table of help voice commands that correspond to keyboard 15 instructions by indicating a particular voice response that is heard through speaker 19.

DETAILED DESCRIPTION OF THE PREFERRED EMBODIMENT

Figure 1:
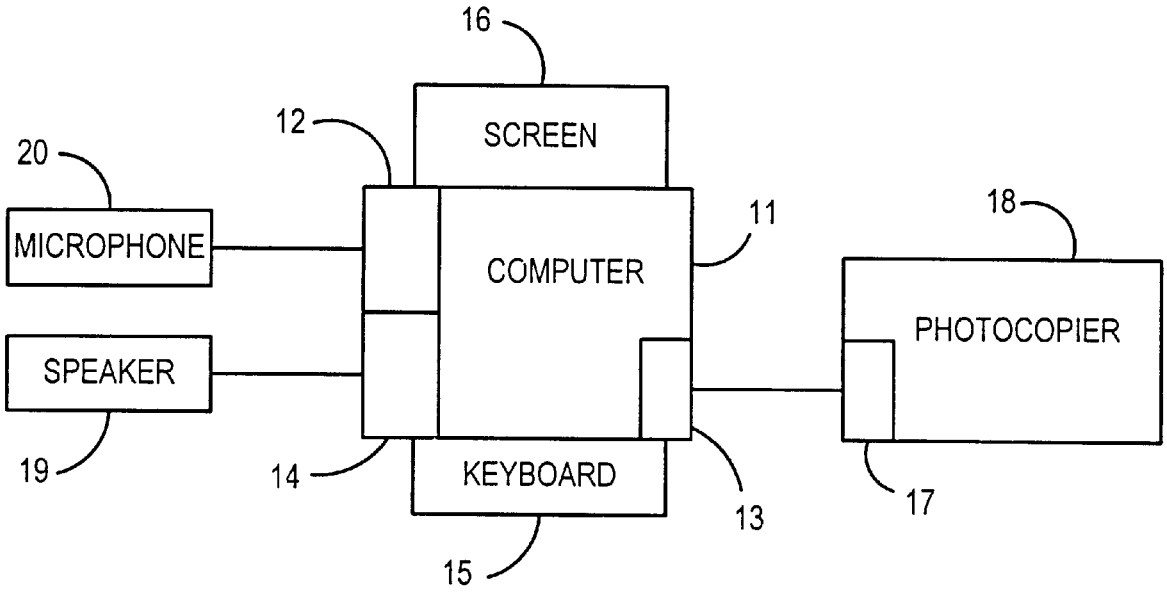
FIG. 1 is a block diagram of this invention.

Referring now to the drawings in detail and more particularly to FIG. 1, the reference character 11 represents an International Business Machine-compatible personal computer. Computer 11 contains: a speech recognition Digital Signal Processor (DSP) board 12; a RS-232 to RS-422 converter board 13; and a sound card 14. Computer 11 also contains a user interface program, which is more fully described in the description of FIG. 8. Speech recognition DSP processor board 12 is manufactured by Verbex Voice System Inc. of Edison, N.J. RS-232 to RS-422 converter board 13 is manufactured by Real Time Control, Inc. of Gainesville, Fla. Keyboard 15 and touch screen 16 that contains a touch screen controller board (not shown) are coupled to computer 11. Touch screen 16 is the ELO 7870 17-inch monitor manufactured by Elo Touch Systems, Inc. of Oak Ridge, Tenn.

The diagnostic port 17 of photocopier 18 is coupled to converter board 13. Photocopier 18 may be the models C235, C285 or C355 photocopiers manufactured by Pitney Bowes Inc. of Stamford, Conn. Speaker 19 is coupled to sound card 14 and microphone 20 is coupled to speech recognition processor board 12.

The user or operator of photocopier machine 18 may operate photocopier machine 18 by speaking into microphone 20. Microphone 20 will convert the speech input into an electrical signal that is transmitted to the input of speech recognition board 12. Board 12 compares the speech pattern of the operator of photocopier 18 with the previously entered training files of the operator of photocopier 20 and recognizes particular voice commands. Then board 20 transmits the above command information to computer 11. Computer 11 translates the aforementioned information into a key stroke that is associated with the particular entered command. After the user of photocopier 18 selects all of his/her choices, the user of photocopier 18 gives the final command, i.e., "print now". All of the information previously spoken by the user of photocopier 18 will be transmitted to converter aboard 13. Converter board 13 will convert this information into the proper format and transmit this information to diagnostic port 17 of photocopier 18.

At this point photocopier 18 will copy the material to be copied in accordance with the user's spoken command instructions that have been input via microphone 20. The keystroke that activated screen 16 will transmit a particular voice file through sound card 18 to speaker 19 as audio feedback. The forgoing is performed as confirmation of the user's commands or for audio help information.

The user may also instruct photocopier 18 by entering commands via touch screen 16. When the user enters the final command on screen 16 by touching that portion of screen 16 that represents the print command, then all of the entered command information is transmitted from computer 11 through board 13 to port 17 and photocopier 18.

The user may also instruct photocopier 18 by entering commands via keyboard 15. When the user enters the final command on keyboard 15 by pressing the key on keyboard 15 that represents the print command, i.e., the key "p", then al of the entered command information is transmitted from computer 11 through board 13 to port 17 and photocopier 18.

Thus, users of photocopier 18 may operate photocopier 18 by entering information from keyboard 15, or touching screen 16 or speaking into microphone 20.

Figure 2:
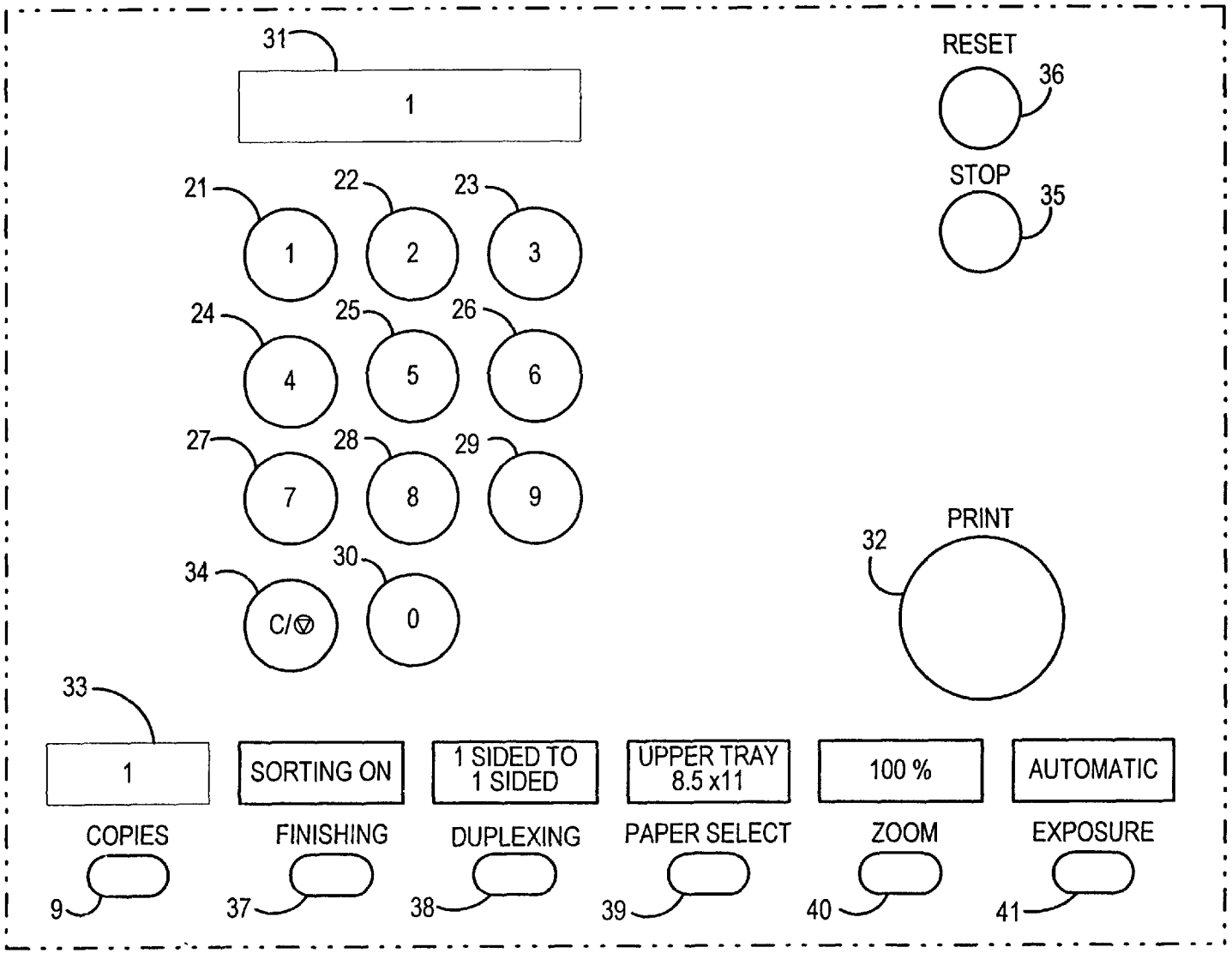
FIGS. 2–7 are drawings of various photocopier 18 command instructions that are displayed on screen 16 and may be executed by touching the proper area of screen 16.

FIGS. 2–7 are drawings of various photocopier 18 command instructions that are displayed on screen 16 and may be executed by touching the proper area of screen 16. FIG. 2 shows the main menu that is used for entering the number of copies that will be made by photocopier 18. Areas 21–30 are used to enter the number of copies that will be made by photocopier 18. The number of copies that were entered is displayed in areas 31 and 33. If the user of photocopier 18 wants photocopier 18 to print the number of copies displayed in areas 31 and 33, the user touches area 32 and photocopier 18 prints the copies. If the user of photocopier 18 wants to stop the previously entered number of copies to be printed, or stop the copier in the middle of the job he/she touches area 35. If the user wants to clear the previously entered number, he/she touches area 34. If the user wants to reset photocopier 18, he/she touches area 36.

When the user of photocopier 18 wants to enter the finishing menu he/she touches area 37. The finishing menu is described in the description of FIG. 3. If the user of photocopier 18 wants to enter the duplexing menu, he/she touches area 38. The duplexing menu is described in the description of FIG. 4. To select the size of paper, the user of photocopier 18 enters the paper select menu by touching area 39. The paper select menu is described in the description of FIG. 5. When the user of photocopier 18 wants to reduce or enlarge the copies, he/she enters the zoom menu by touching area 40. The zoom menu is described in the description of FIG. 6. When the user of photocopier 18 wants to enter the exposure menu, he/she touches area 41. The exposure menu is described in the description of FIG. 7. When the user wants to enter the copy menu from a different screen, he/she touches area 9.

Figure 3:
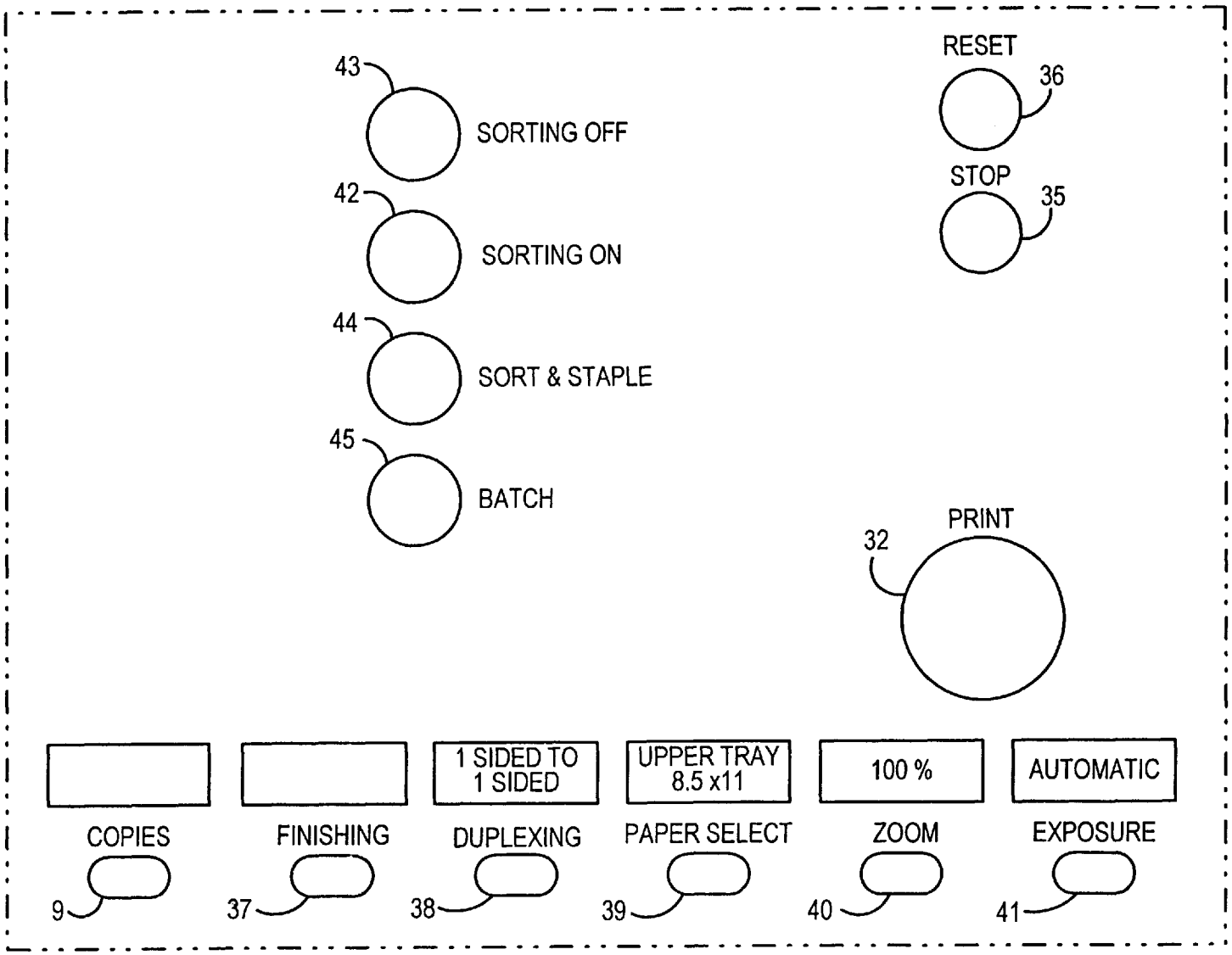

FIG. 3 illustrates the sorting menu. Area 42 is used to turn the sorting function on and area 43 is used to turn the sorting function off. Area 44 is used to sort and staple and area 45 is used for batch jobs.

Figure 4:
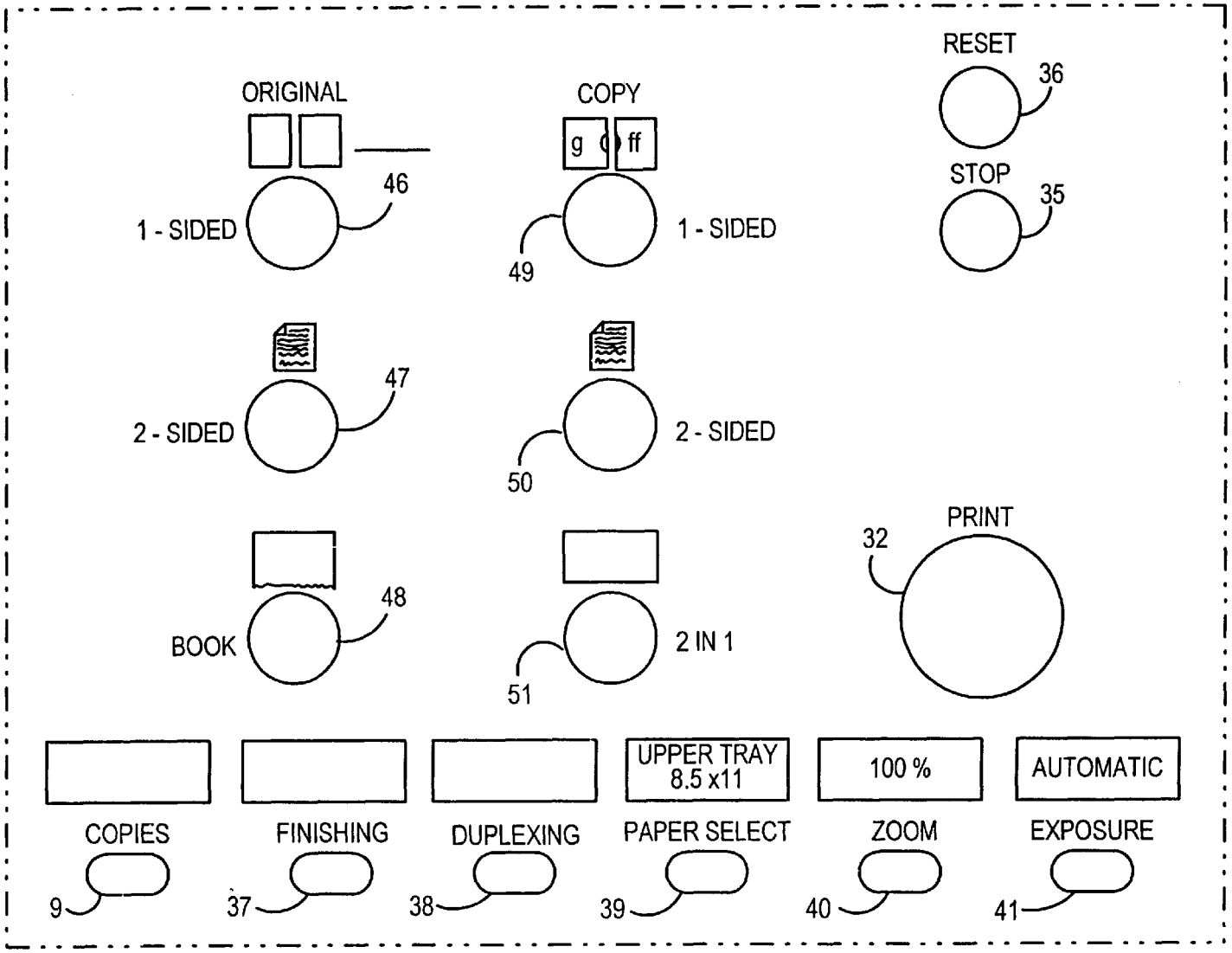

FIG. 4 illustrates the duplexing menu. Area 46 is touched when the paper to be copied is one sided and area 47 is touched when the paper to be copied is two sided. Area 48 is touched when the material to be copied is in a book. Area 49 is touched when the user wants the copies to be one sided and area 50 is touched when the user wants the copies to be two sided. Area 51 is touched when the user wants a two sided copy to be made on one sheet of paper.

Figure 5:
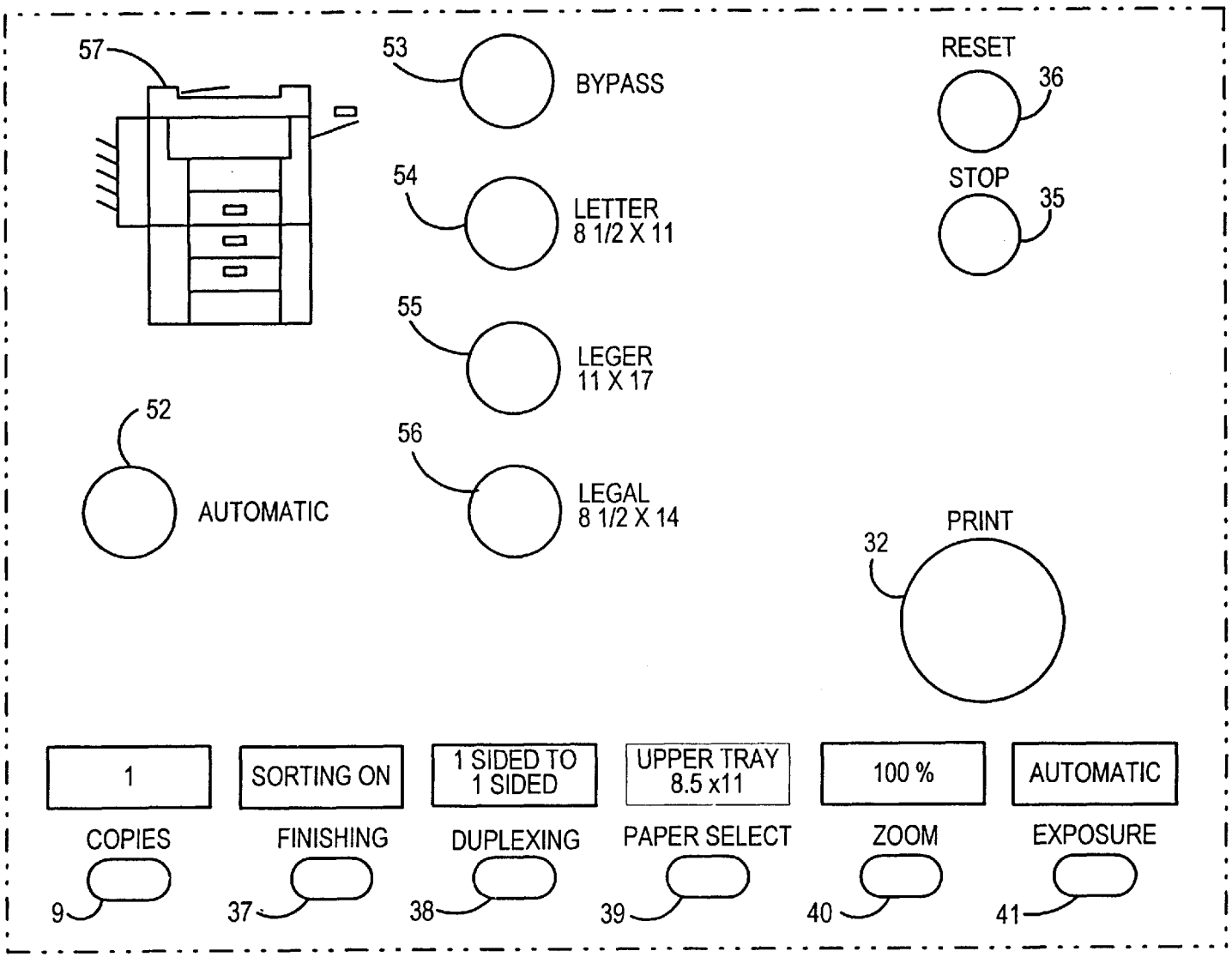

FIG. 5 illustrates the paper selection menu. Area 52 is touched when the user wants photocopier 18 to be in the automatic mode and area 53 is touched when the user wants photocopier 18 to be in the bypass mode. Area 54 is touched when letter size (8½"×11") copies are desired and area 55 is touched when ledger size (11"×17") copies are desired. Area 56 is touched for legal size (8½"×14") copies. Area 57 shows where the different sizes of paper are located in photocopier 18.

Figure 6:
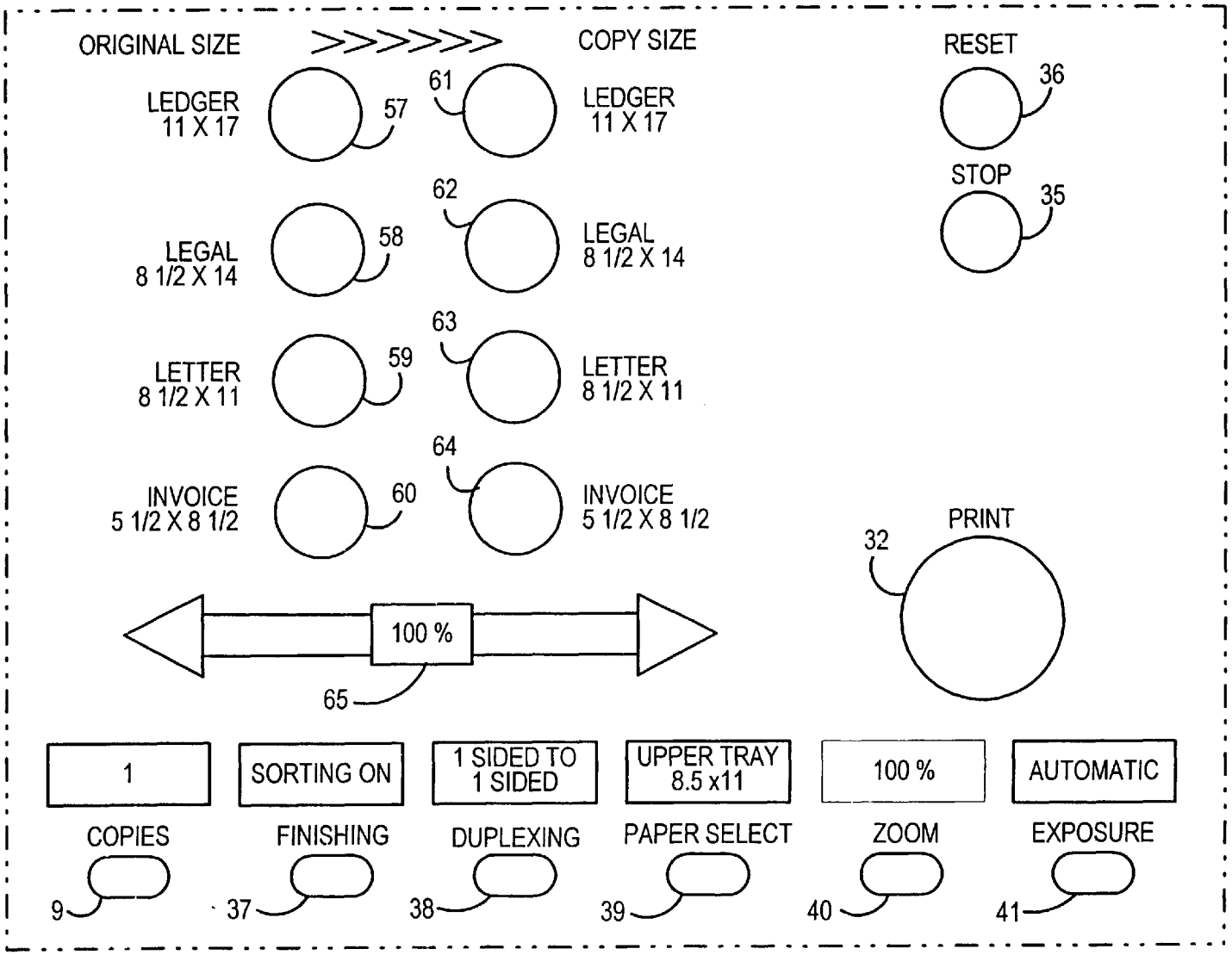

FIG. 6 illustrates the zoom menu. The user touches area 57 if the material to be copied is ledger size and the user touches area 58 if the material to be copied is legal size. The user touches area 59 if the material to be copied is letter size and the user touches area 60 if the material to be copied is invoice (5½"×8½") size. The user touches area 61 if the copied material is desired to be ledger size and the user touches area 62 if the copied material is desired to be legal size. The user touches area 63 if the copied material is desired to be letter size and the user touches area 64 if the copied material is desired to be invoice size. Area 65 represents the percentage of enlargement (50%–200%) or reduction (50%–200%) of the copy to be made.

Figure 7:
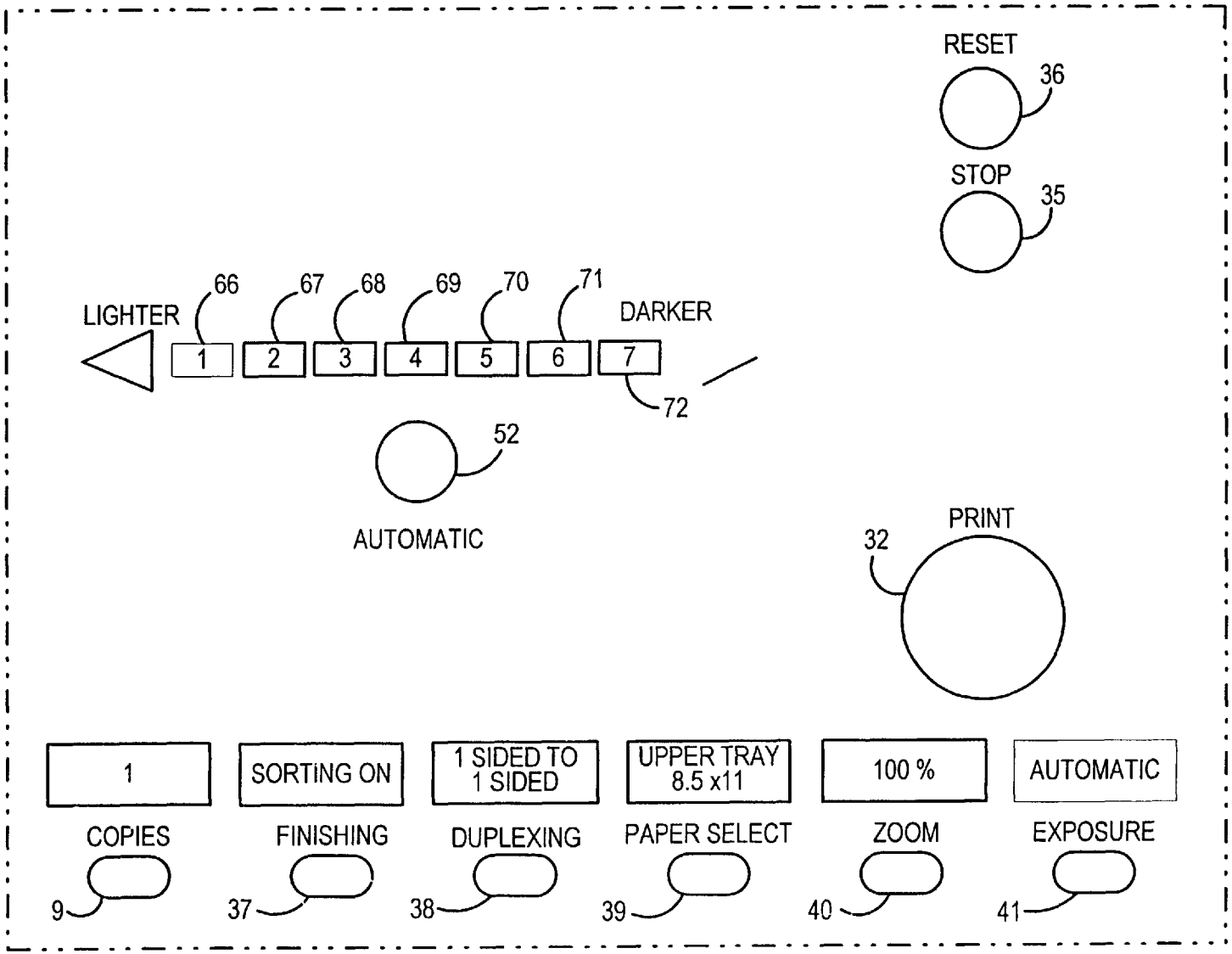

FIG. 7 illustrates the exposure menu. Areas 66–77 are used to set the degree of darkness of the copy. Area 67 is touched for light copies and area 72 is touched for dark copies. Thus, the higher the number of the area touched, the darker will be the copy.

Figure 8:
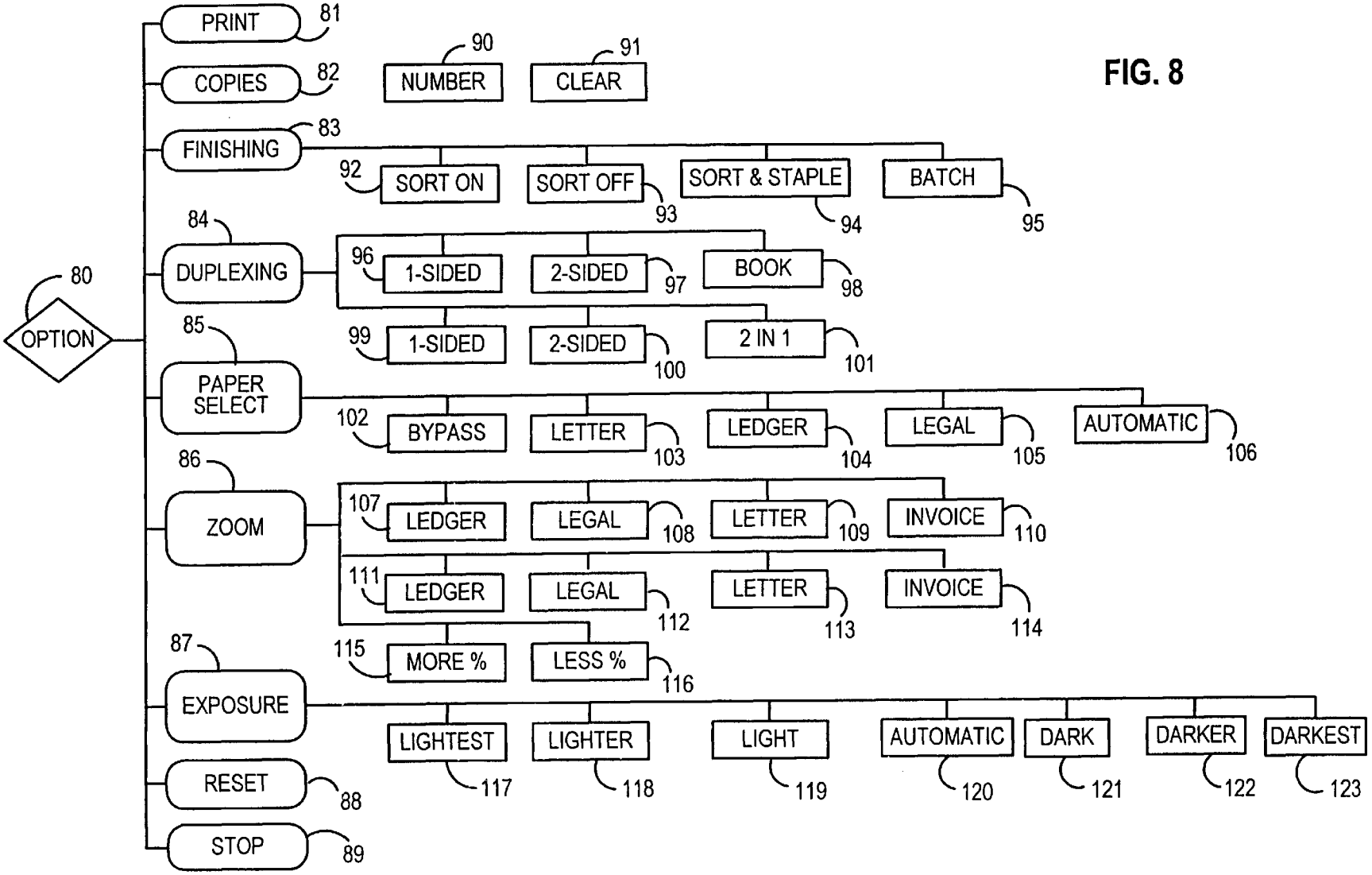
FIG. 8 is a drawing showing the functions of the user interface program of computer 11.

FIG. 8 is a drawing showing the functions of the user interface program of computer 11. The program begins in block 80 options. The user of computer 11 may select the following main functions: block 81 print; block 82 copies; block 83, type of finishing desired; block 84 duplexing; block 85 type of paper selected; block 86 zoom; block 87 exposure; block 88 reset and block 89 stop.

If copies are selected, the user enters the number of copies desired in block 90. If a mistake was made in block 90, the program goes to block 91 to allow the user to clear the number previously entered in block 90. When block 83 finishing is selected, the user may turn the sorter on block 92, turn the sorter off block 93, sort and staple block 94 and batch block 95. If duplexing was selected: block 96 would represent one sided sheets that are going to be photocopied; block 97 would represent two sided sheets that are going to be photocopied and block 98 would indicate that a book was going to be photocopied; block 99 would represent that the copy was going to be made on one side of the paper; block 100 would represent that the copy was to be made on both sides of the paper; and block 101 would represent that a two sided copy would be made on two sheets of paper. If paper select was selected, block 102 would indicate bypass; block 103 would indicate letter size paper; block 104 would indicate ledger size paper; block 105 would indicate legal size paper and block 106 would be the automatic mode where the photocopier selects the size of the paper. If zoom was selected: block 107 would represent that ledger sheets are going to be photocopied; block 108 would represent that legal sheets are going to be photocopied; block 109 would represent that letter sheets are going to be photocopied; block 110 would represent that invoices are going to be photocopied; block 111 would represent that the copy was going to be made on ledger size paper; block 112 would represent that the copy was going to be made on legal size paper; block 113 would represent that the copy was going to be made on letter size paper; block 114 would represent that the copy was going to be made on invoice paper; block 115 would enable the user to indicate how much larger than the original the copy should be and block 116 would enable the user to indicate how much smaller than the original the copy should be. If block 87 was selected: block 119 would indicate the lightest copy; block 118 would indicate a lighter copy; block 119 would indicate a light copy; block 120 would indicate a automatic copy; block 121 would indicate a dark copy; block 122 would indicate a darker copy; and block 123 would indicate the darkest copy. Block 88 would reset the main functions and block 89 would cancel the previously entered functions. Block 81 would print the copy in accordance with the previously entered functions.

FIGS. 9A and 9B are tables of voice commands and corresponding keyboard entries. The voice commands are shown in column 200 and the corresponding keyboard entry is shown in column 201.

The following will illustrate how this table is used. When the operator of photocopier 18 wants to make four copies on letter size paper, he/she would speak into microphone 20 and say "four copies, letter, print now". Microphone 20 would transmit the above commands to speech recognition board 12 and board 12 would process these commands by converting them to their corresponding keystroke commands, i.e., the commands used by keyboard 15. The keystroke commands would then be sent to computer 11. The keystroke commands for the abovementioned voice command would be O, 4, Sl, p. After computer 11 recognized the above command, it would cause sound card 14 to repeat, in a previously digitized format, the command sent by the operator of photocopier 18. Thus, after each voice command, speaker 19 would output the current command, i.e., "four copies, letter, print now".

Execution of the above command would take place simultaneously when speaker 19 outputted "print now" and photocopier 18 began printing.

FIG. 10 is a table of help voice commands that correspond to keyboard 15 instructions by indicating a particular voice response that is heard through speaker 19. The voice commands are shown in column 205, the corresponding keyboard entry is shown in column 206 and the voice response is shown in column 207.

The following will illustrate how this table is used. When the operator of photocopier 18 wants to know the photocopier 18 options, he/she would speak into microphone 20 and say "copier options". Microphone 20 would transmit the above commands to speech recognition board 12 and board 12 would process these commands by converting them to their corresponding keystroke commands, i.e., the commands used by keyboard 15. The keystroke commands would then be sent to computer 11. The keystroke commands for the abovementioned voice command would be O]. After computer 11 recognized the above command, it would cause sound card 14 to repeat, in a previously digitized format, the command sent by the operator of photocopier 18. Thus, speaker 19 would output, for example, "4 copies, letter, print".

All error messages or messages concerning the status of photocopier 18 outputted by photocopier 18 will also be converted to voice messages, i.e., paper jam, lack of toner, etc. For example, if a paper jam occurred, the diagnostic port 17 of photocopier 18 (FIG. 1) would transmit a signal to computer 11 via converter board 13. Computer 11 would identify the status of photocopier 18, i.e., jam and display an error message on screen 16. Simultaneously, computer 11 would transmit the error message to sound card 14. Sound card 14 will cause speaker 19 to broadcast an audio message of the same text that appears on screen 16, i.e., "paper jam, area 3". After the paper jam is cleared, screen 16 will return to its normal state.

The above specification describes a new and improved system for controlling and operating photocopier machines. It is realized that the above description may indicate to those skilled in the art additional ways in which the principles of this invention may be used without departing from the spirit. It is, therefore, intended that this invention be limited only by the scope of the appended claims.

What is claimed is:

1. A bi-directional system for commanding and controlling a photocopier, said system comprising:

a computer that controls the operation of the photocopier;

means for entering user voice commands into said computer so that said computer will recognize the voice commands and cause said photocopier to print copies according to certain selected parameters; and means coupled to said computer for reporting to the user the status of the photocopier; wherein the reporting means comprises:

diagnostic means contained within the photocopier indicating the status of the photocopier to the computer;

a sound card that produces a digitized audio signal associated with the status of the photocopier; and a speaker coupled to the output of the sound card, wherein the speaker produces an audible signal to the user repeating the user's voice command.

2. The system claimed in claim 1, further including:

means coupled to said computer for confirming said voice commands by producing a digitized audio signal output that repeats the entered voice command.

3. The system claimed in claim 2, wherein said means for confirming comprises:

a sound card that produces a digitized audio signal; and a speaker coupled to the output of the sound card, wherein the speaker produces a audible signal.

4. The system claimed in claim 1, wherein said means for entering voice commands comprises:

a microphone for converting audio command signals into electrical signals; and means coupled to said microphone for converting said audio command signals into keystroke commands, wherein the converting means is coupled to the computer.

5. The system claimed in claim 4, wherein said converting means is a speech recognition board.

6. The system claimed in claim 1, further including:

a keyboard coupled to said computer for entering key commands into said computer so that said computer will cause said photocopier to print copies according to certain selected parameters.

7. The system claimed in claim 1, further including:

a touch screen coupled to said computer for entering touch commands into said computer so that said computer will cause said photocopier to print copies according to certain selected parameters.

* * * * *